US006002202A

United States Patent [19]

Meyer et al.

[11] Patent Number: 6,002,202

[45] Date of Patent: Dec. 14, 1999

[54] RIGID THIN WINDOWS FOR VACUUM APPLICATIONS

[75] Inventors: Glenn Allyn Meyer, Danville; Dino R. Ciarlo; Booth Richard Myers, both of Livermore; Hao-Lin Chen, Lafayette; George Wakalopulos, Pacific Palisades, all of Calif.

[73] Assignee: The Regents of the University of California, Oakland, Calif.

[21] Appl. No.: 08/684,166

[22] Filed: Jul. 19, 1996

[51] Int. Cl.[6] ..... H01J 33/00; G21K 1/00

[52] U.S. Cl. ..... 313/420; 378/161

[58] Field of Search ..... 313/420; 216/49, 216/79, 100, 108, 109, 24; 438/704, 924; 430/5; 250/505.1; 398/161

[56] References Cited

U.S. PATENT DOCUMENTS

| | | | |
|---|---|---|---|
| 3,611,418 | 10/1971 | Uno et al. | 346/74 ES |
| 4,098,651 | 7/1978 | Alder | 204/1 T |
| 4,468,282 | 8/1984 | Neukermans | 156/633 |
| 4,515,876 | 5/1985 | Yoshihara et al. | 430/5 |
| 4,675,525 | 6/1987 | Amingual | 250/338 |
| 4,910,435 | 3/1990 | Wakalopulos | 315/111.31 |
| 4,956,835 | 9/1990 | Aden | 430/5 |
| 5,414,267 | 5/1995 | Wakalopulos | 250/492.3 |
| 5,612,588 | 3/1997 | Wakalopulos | 313/420 |

OTHER PUBLICATIONS

Electron Window Cathode Ray Tube Applications, L. Hanlon, M. Greenstein, W. Grossman, and A. Neukermans, J. Vac. Sci. Technol. B 4 (1), Jan./Feb. 1986, pp. 305–309.

*Primary Examiner*—Ceila Chang
*Attorney, Agent, or Firm*—Daryl S. Grzybicki

[57] ABSTRACT

A thin window that stands off atmospheric pressure is fabricated using photolithographic and wet chemical etching techniques and comprises at least two layers: an etch stop layer and a protective barrier layer. The window structure also comprises a series of support ribs running the width of the window. The windows are typically made of boron-doped silicon and silicon nitride and are useful in instruments such as electron beam guns and x-ray detectors. In an electron beam gun, the window does not impede the electrons and has demonstrated outstanding gun performance and survivability during the gun tube manufacturing process.

20 Claims, 4 Drawing Sheets

RIGID THIN WINDOWS FOR VACUUM APPLICATIONS

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the fabrication of rigid thin windows for vacuum applications, such as electron guns or x-ray detectors. In particular, the windows are made using photolithographic and wet chemical etching techniques.

2. Description of Related Art Thin film windows are used in applications where it is necessary to separate a vacuum environment from another environment, such as ambient atmosphere, a gaseous environment, or a liquid. These vacuum applications include electron and ion guns, x-ray tubes, x-ray detectors, and chambers transmitting other electromagnetic radiation or charged or neutral particles. The window must be able to withstand the pressure difference and possibly a high temperature environment, while not significantly impeding the beam of particles or radiation passing through the window.

An important application of thin film windows is in electron beams, which are used in industry for rapid curing of inks and paint, surface treatment of paper products, and destruction of organic waste solvents. The electron beam tubes typically used in these applications have electron windows made of 15 micron thick titanium foil. The electron window must be thin enough to allow electrons to pass through, be gas impermeable, and have sufficient strength to stand off an atmosphere of pressure drop. These guns typically operate in the 150 to 175 kilovolt range.

Recent advances in electron gun design allow for the operation of electron guns at much lower voltages. These improved electron guns do not require pumping and are designed to efficiently produce an electron beam in air with voltages below 100 kilovolts and as low as 25 kilovolts. An integral part of this electron gun is the thin, several micron thick window that stands off atmospheric pressure (1 atm) and permits electrons generated by the electron source to pass from the evacuated side to the outside. The window must be capable of transmitting electron current densities of several milliamperes per square centimeter into air with 90% efficiencies at 50 kilovolts for thousands of hours of operation. In addition, the window must also survive a high temperature bonding operation for attachment to the electron tube.

A method of making an electron beam window is discussed in U.S. Pat. No. 4,468,282 issued Aug. 28, 1984 to Neukermans. The electron permeable windows are fabricated by depositing a single layer of an inert, high strength, low atomic number material onto a substrate. The window pattern is photolithographically defined and the substrate is etched to leave the window structure. Neukermans produces a simple single layer window that is susceptible to breakage throughout the manufacturing and bonding process.

An improved window structure and composition has been developed which significantly increases window durability and allows the use of the windows in a wide variety of environments, including very corrosive ones. The present invention produces a micromachined bi-material window with a rigid support frame structure, which has demonstrated impressive electron gun performance and improved window survivability during window bonding operations.

SUMMARY OF THE INVENTION

The present invention is a method for fabricating thin, robust windows that are used as vacuum standoff windows. These windows can be used in applications such as electron guns, low voltage electron guns, ion guns, x-ray tubes, x-ray detectors, or in chambers transmitting other electromagnetic radiation or charged or neutral particles. The window design and composition provide superior structural stability, which dramatically improves the manufacturing yield and lifetime of the windows. The windows are typically made from a single crystal of silicon with two or more thin layers, where one layer is an etch stop layer, and another layer acts as a protective, strengthening barrier. The windows are fabricated by precision wet anisotropic etching of single crystal silicon.

The windows are typically constructed from a double-side polished (100) oriented single silicon crystal wafer. The wafer is preferably either doped by a high temperature diffusion process or deposited with a coating of doped, epitaxial, stress compensated silicon to form an etch stop layer. The wafers are then coated with a low stress barrier layer, such as silicon nitride. This wafer is coated (both sides) first with a photoresist adhesion promoter and then with a positive photoresist, which is soft baked. The backside of the wafer is patterned, and the wafer is oriented so that the windows are parallel to the crystallographic orientation of the silicon. The silicon nitride is etched in the areas where the photoresist is absent, and then the photoresist is removed. The wafer undergoes a wet anisotropic silicon etching using a 44% potassium hydroxide solution with isopropyl alcohol. The silicon etch effectively stops at the first doped layer.

In the preferred embodiment, the windows are constructed of two material layers on a (100) silicon wafer: the top layer comprises about 2,500–3,000 Å of low stress, low pressure chemical vapor deposition (LPCVD) silicon nitride, and the lower layer comprises about 0.5–3 $\mu$m of boron or phosphorous doped germanium strain compensated epitaxial silicon. The wafers are patterned and etched to include parallel tapered silicon support ribs running periodically along the width of the windows. The windows are further supported by a silicon support frame.

For electron gun windows, the doped silicon layer provides strength and an electrically conductive path to remove the electron charge buildup on the window. When exposed to the ionized gas species during gun operation, the low stress LPCVD silicon nitride layer provides a chemically resistant barrier to these ions and also enhances the window's mechanical strength. The silicon nitride layer also acts as a mask or protective barrier during the silicon etching process.

DETAILED DESCRIPTION OF THE INVENTION

Figure 1A:
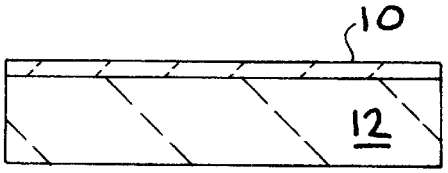
FIGS. 1A–1H show the window fabrication process according to the present invention.

The present invention is a method for fabricating thin film windows for vacuum applications, such as electron guns. The windows are made from a silicon wafer that comprises at least two layers: one layer acting as an etch stop layer, and another layer acting as a protective barrier that enhances the window's mechanical strength. The multi-material windows are etched using wet anisotropic etching techniques and include parallel support ribs running along the width of the windows, which increases their lifetime and durability.

Substrate Material

The typical substrate material for fabricating windows according to the present invention is silicon of semiconductor grade. Two basic semiconductor grades of silicon are commercially available: prime grade and test grade. Prime grade silicon wafers are used for the fabrication of semiconductor devices and are suitable for the present vacuum stand-off windows. Test grade material is typically used for process characterization studies and is not used for fabrication of actual semiconductor devices, nor should it be used to fabricate windows. The oxygen inclusions and dislocations found in test grade silicon can cause pinhole formation in silicon membranes during the etching process. In addition, excessive wafer taper or bow may cause uneven etching.

The present window design uses double side polished (100) oriented single crystal silicon wafers. Some electron gun windows have been fabricated from (110) silicon wafers, which enables thin 100 $\mu$m wide straight wall ribs to be etched in the silicon for structural support. The (110) wafers are more costly and not as readily available as (100) wafers, however, so (100) oriented silicon is preferred.

Clean silicon wafer surfaces are essential for all steps of the window fabrication process. Particulate, organic, and inorganic surface contamination can drastically reduce product yields and performance. The predominant silicon wafer cleaning processes used in advanced semiconductor fabrication were developed at RCA Laboratories. These cleaning processes (referred to as RCA-type wet clean processes) remove particulate, organic, metallic, and inorganic contaminants from the surfaces of silicon wafers. The RCA clean uses two steps called Standard Clean 1 (SC-1) and Standard Clean 2 (SC-2).

The SC-1 step uses a solution of 5:1:1 by volume ratio of deionized water ($H_2O$), hydrogen peroxide 30% ($H_2O_2$), and ammonium hydroxide ($NH_4OH$) at 75° C. for 10 minutes, followed by a deionized water rinse. This step removes particles, organic contaminants, and the following metal contaminants: group IB, group IIB, Au, Ag, Cu, Ni, Cd, Co, and Cr. A solution temperature of 75° C.±5° C. should be maintained during the cleaning process. Since the SC-1 solution both dissolves and regrows the native oxide layer on the silicon surface, particles are readily displaced and removed.

The SC-2 step uses a mixture of 6:1:1 by volume ratio of deionized water ($H_2O$), hydrogen peroxide 30% ($H_2O_2$), and hydrochloric acid 38% (HCl). The solution temperature is maintained at 75° C. The wafers are immersed in 75° C.±5° C. SC-2 solution, followed by a deionized water rinse. The SC-2 solution removes both trace metals (Al, Fe, Mg, Zn) and alkali ions. Since the hydrochloric acid in the SC-2 solution does not etch or oxidize the silicon, this process is more tolerant to process variations than the SC-1 process.

Etch Stop Layer Formation

After the silicon substrate has been cleaned, the windows are fabricated using the process shown in FIGS. 1A–H. FIG. 1A shows the first step, in which an "etch stop" layer 10 is incorporated into the silicon wafer 12. This layer 10 will effectively stop the etching process while the wafer 12 is later etched to produce the windows. The layer 10 may be comprised of doped silicon, or a conductive carbide, nitride, or boride. Examples include $B_4C$, HfC, NbC, TiC, ZrC, AlN, HfN, NbN, $Nb_2N$, TiN, TaN, $Ta_2N$, ZrN, $HfB_2$, $NbB_2$, $TaB_2$, $TiB_2$, and $ZrB_2$. In the preferred embodiment, the etch stop layer 10 is formed of doped silicon or doped silicon carbide having a thickness in the range of about 0.5–3 $\mu$m.

Doped silicon is advantageous because the anisotropic etchant used to fabricate the windows is sensitive to high concentrations of certain dopants in the silicon substrate, so the etching process effectively stops at this highly doped silicon layer. These dopants, either "p-type" or "n-type", are added to silicon during crystal growth to change the resistivity and conductivity type. Boron is the most common p-type dopant used. N-type dopants include phosphorous, antimony, and arsenic, with phosphorous being the most common. For boron in particular, the silicon etch rate in the <100> directions in alkaline anisotropic silicon etchants decreases rapidly at boron concentrations in the $2\times10^{19}$ atoms/cm$^3$ range in the silicon. At boron concentrations in the $1\times10^{20}$ atoms/cm$^3$ range, the etch rate is further reduced by a factor of 100, providing an effective etch stop in the etching process.

The incorporation of precise concentrations of boron in silicon is a well established process in the semiconductor industry. Typically, boron doping of silicon is performed by either diffusion or ion implantation processes. Since the ion implantation process is both costly and generates high crystal lattice damage at the high boron concentrations required for the etch stop process, the diffusion process is the most common method used for this application.

The diffusion process involves heating the silicon wafers in a resistance heated quartz tube furnace at temperatures ranging from 800° C. to 115° C. and exposing the wafers to a dopant source. The dopant concentration is temperature dependent and is determined by the dopant's solid solubility in silicon. For example, the solid solubility of boron in silicon is $5\times10^{19}$ atoms/cm$^3$ at 800° C. and $2\times10^{20}$ atoms/cm$^3$ at 1150° C. The diffusion depth is controlled by time.

The most common boron dopants are diborane gas ($B_2H_6$), boron nitride solid (BN), and boron tribromide liquid ($BBr_3$). Boron nitride is the predominant dopant used for boron diffusion processes due to the high dopant uniformity, ease of use, and non-toxicity. Both diborane and boron tribromide are highly toxic corrosive dopant systems. For all boron doping systems, the doping process is typically run under oxidizing conditions, which results in deposition of a boron oxide ($B_2O_3$) glass onto the surface of the silicon. Silicon dioxide ($SiO_2$) is the most common mask used to control the diffusion locations on the surface of the silicon wafer. One micron thick thermally grown silicon dioxide films are required to mask a 10 hour boron diffusion process at 1100° C.

Figure 2:
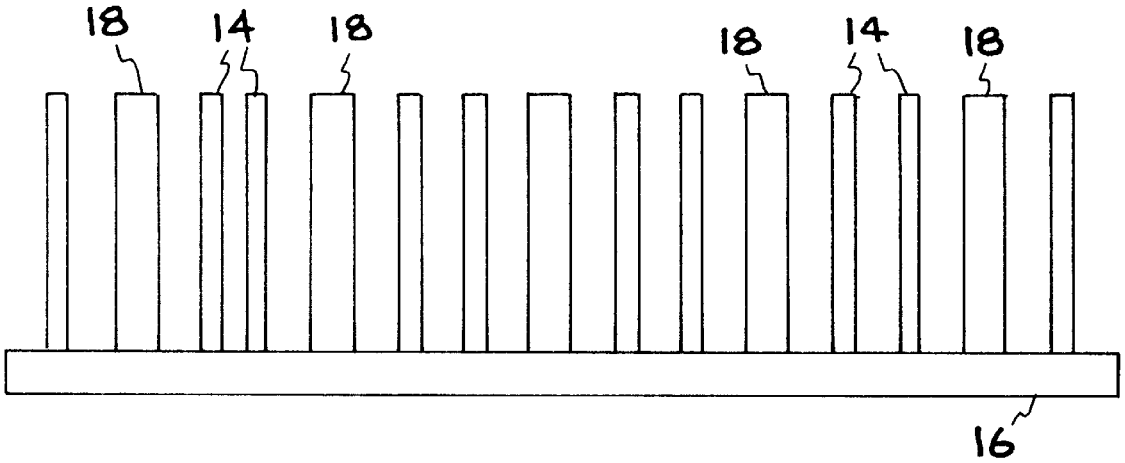
FIG. 2 shows a silicon wafer loading arrangement for solid source doping.

FIG. 2 shows a wafer loading arrangement for boron nitride dopant sources. The silicon wafers 14 to be doped are placed back to back in a quartz diffusion boat 16 so that the silicon wafer surfaces to be doped face a boron nitride source wafer 18. This close proximity loading arrangement of the dopant wafers 18 to the silicon wafers 14 allows for uniform transport of the dopant species to the surface of the silicon wafers 14. A typical boron diffusion process used to fabricate 1.5 μm thick silicon windows is described in Table I.

TABLE I

| Step | Operation | Time (minutes) | Temperature (° C.) | Process Gas |
|---|---|---|---|---|
| 1 | push wafers into furnace | 10 | 750 | 6 lpm $N_2$ |
| 2 | temperature ramp up | 60 | 750–1100 | 6 lpm $N_2$ |
| 3 | $O_2$ injection | 60 | 1100 | 30 ccm $O_2$/6 lpm $N_2$ |
| 4 | soak | 150 | 1100 | 6 lpm $N_2$ |
| 5 | temperature ramp down | 60 | 1100–750 | 6 lpm $N_2$ |
| 6 | pull wafers out of furnace | 10 | 750 | 6 lpm $N_2$ |

Prior to the diffusion process, the silicon wafers are cleaned using the RCA SC-1 and SC-2 steps. A silicon dioxide layer (1 μm thick) is then grown on the wafers to provide a diffusion barrier to the boron diffusion on the backside (etched side) of the wafer. The 1 μm thick thermally grown oxide is formed by heating the silicon wafers in a resistance heated quartz tube furnace to 1100° C. in a wet oxygen ambient for 125 minutes. The oxygen/nitrogen process gas is bubbled through 95° C. water to provide the wet oxygen ambient.

Once the oxide layer is grown, photoresist is then coated on the backside of the wafer and hard baked. The wafers are then submerged into a 10:1 deionized water: buffered hydrofluoric acid solution to remove the oxide from the front side (side to be doped) of the wafer. The photoresist protects the oxide on the backside of the wafer from the hydrofluoric acid. The photoresist is then stripped and the wafers are loaded into the quartz diffusion boat as shown in FIG. 2. At the completion of the diffusion process, the wafers are removed and inserted into a 10:1 deionized water: buffered hydrofluoric acid solution to remove the boron oxide glass and the silicon oxide masking oxide layer on the backside of the wafers.

During the diffusion process, the boron concentration at the surface of the silicon is greater than the solid solubility limit, resulting in the formation of a silicon boride layer or Si-B phase. This layer traps crystal defects (oxygen induced stacking faults) at the silicon/Si-B interface and results in strong gettering action. This boron rich layer is not removed by hydrofluoric acid and must first be oxidized before it can be removed by hydrofluoric acid. A low temperature oxidation (LTO) is thus performed on the wafers to oxidize the Si-B phase. The LTO process used for this diffusion process involves a 30 minute oxidation in dry oxygen at 750° C. The oxide is then subsequently stripped in a 10:1 deionized water: buffered hydrofluoric acid solution. The wafers are then ready for the next process step (barrier layer deposition).

As an alternative to diffusion, the etch stop layer can be fabricated from boron doped epitaxially grown silicon films. Epitaxial deposition is a unique crystal growth process and refers to the growth of a single crystal layer on a substrate where the crystal structure of the deposited layer is an extension of the underlying single crystal substrate. The epitaxial silicon deposition is achieved by a chemical vapor deposition (CVD) process, which involves exposing the wafers to silicon tetrachloride ($SiCl_4$) and hydrogen ($H_2$) in a reactor at 1150° to 1300° C. Doping is performed in situ by introducing dopant gases during the deposition process.

The substitution of the smaller boron atoms for larger silicon atoms in boron doped silicon layers generates strain due to the shrinkage of the silicon crystal lattice. As the thickness of the highly boron doped layer increases, the interfacial stress between the doped and undoped region increases. When the critical interfacial stress is reached, crystal defects (dislocations) are generated through plastic deformation of the lattice.

The interfacial strain in heavily boron doped silicon layers can be reduced through the introduction of larger atomic radii impurity atoms to the boron doped silicon lattice. This is achieved by simultaneously doping ("co-doping") silicon with boron and elements like tin or phosphorous and tin. The strain compensation of boron doped epitaxial silicon films co-doped with germanium has been investigated, resulting in a range of allowed strain for dislocation-free epitaxial layers of about 2–4 μm in thickness.

High quality boron doped, germanium strain compensated, epitaxial silicon films can be produced using an atmospheric pressure chemical vapor deposition system operated at 1200° C. Silicon tetrachloride ($SiCl_4$), diborane ($B_2H_6$), and germane ($GeH_4$) are fed into the reactor using a hydrogen carrier gas. The thickness of the epitaxial silicon is controlled by adjusting the time that the wafers are in the reactor. By varying the $GeH_4$ flow rate, the film stress can be adjusted from tensile to compressive. Excellent results have been obtained from epitaxial silicon layers stain compensated to a tensile stress of −50 MPa ($5\times10^8$ dynes/cm$^2$).

Barrier Layer Deposition

Figure 1B:
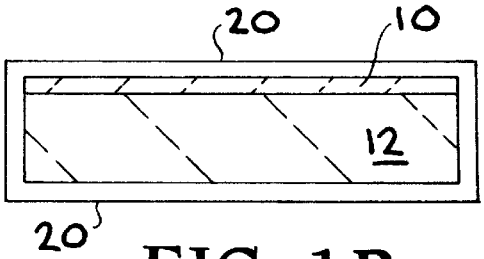

After the etch stop layer is established, a protective barrier layer 20 is incorporated into the silicon substrate 12 on top of the etch stop layer 10, as shown in FIG. 1B. The barrier layer 20 may be comprised of borides, carbides, nitrides, or oxides, such as $B_4C$, HfC, NbC, doped SiC, TiC, ZrC, $Si_3N_4$, AlN, HfN, NbN, $Nb_2N$, TiN, TaN, $Ta_2N$, ZrN, $HfB_2$, $NbB_2$, $TaB_2$, $TiB_2$, $ZrB_2$, $A1_2O_3$, $ZrO_2$, and $Ta_2O_5$. A third layer of these borides, carbides, nitrides, or oxides may be formed on top of the barrier layer 20 for additional chemical protection under severe conditions. The preferred material for the barrier layer 20, particularly for electron gun window applications, is silicon nitride ($Si_3N_4$).

Silicon nitride has an advantageous combination of properties: radiation hardness, thermal and chemical resistance to high temperature caustic etch solutions (KOH), high mechanical strength (3,200 MPa), high Young's modulus (385 GPa), and high temperature oxidation resistance (100× more resistant than Si). Low Pressure Chemical Vapor Deposition (LPCVD) low stress silicon nitride coatings provide the necessary protection during the silicon etching operations and provide improved mechanical strength and enhanced oxidation resistance during electron gun operations.

A silicon nitride layer may be deposited by reacting dichlorosilane ($SiCl_2H_2$) and ammonia ($NH_3$) at reduced pressure (300 mTorr) at 800° C. The chemical reaction is:

$$3SiCl_2H_2+4NH_3\rightarrow Si_3N_4+6HCl+6H_2.$$

The silicon nitride thickness is directly proportional to the deposition time, temperature, and total pressure. In addition, the deposition rate is increased by increasing the partial pressure of dichlorosilane and is decreased with increasing ammonia to dichlorosilane ratio.

Silicon nitride films (stoichiometric $Si_3N_4$) deposited on silicon typically have high tensile stress in the −1,000 MPa ($1\times10^{10}$ dyne/cm$^2$) range. By increasing the silicon to nitrogen ratio by slightly increasing the dichlorosilane:ammonia ratio, the film stress can be reduced. Low stress films have a tensile stress in the −50 to −500 MPa ($5\times10^8$–$5\times10^9$ dynes/cm$^2$) range. The exact reactor conditions necessary to form low stress high quality silicon nitride films are empirically determined. Film stress can vary widely from run to run using identical process conditions. Factors known to influence film stress include reactor design, boat postion, wafer loading, tube cleaning, and vacuum pump design and condition.

Low stress silicon nitride films are typically deposited in a Low Pressure Chemical Vapor Deposition (LPCVD) tube furnace. For optimum coatings, the wafers must be clean, dry, and particle free prior to nitride deposition. The standard RCA cleaning procedures, as outlined earlier, yield satisfactory cleaning results. Surface particles found on the wafers after the cleaning process are removed with a filtered high-pressure nitrogen blow-off gun. The clean wafers are then transferred into a quartz boat and loaded into the furnace.

2500–3,000 Å thick coating of low tensile stress (−100 to −300 MPa) silicon nitride may be deposited following the procedure described in Table II. At the completion of the deposition run, both film thickness and film stress are measured. If the film thickness or stress are out of specification, the nitride film can be stripped in concentrated hydrofluoric acid, RCA cleaned, and redeposited.

TABLE II

| Step | Operation | Time | Temperature (° C.) | Pressure | Gas |
|---|---|---|---|---|---|
| 1 | RCA clean (SC-1 & SC-2) | | | | |
| 2 | load wafers | | 400 | 1 ATM | $N_2$ purge |
| 3 | pumpdown | | 400 | 5 mTorr | |
| 4 | $N_2$ purge | | 400 | 200 mTorr | $N_2$ purge |
| 5 | pumpdown | | 400 | 5 mTorr | |
| 6 | $N_2$ purge | | 400 | 200 mTorr | $N_2$ purge |
| 7 | pump down | | 400 | 5 mTorr | |
| 8 | $N_2$ purge | | 400 | 200 mTorr | $N_2$ purge |
| 9 | pump down | | 400 | 5 mTorr | |
| 10 | temp. ramp to 800° C. | ~1 hour | 400–800 | 5 mTorr | |
| Note: deposition is initiated once the temperature has stabilized at 800° C. | | | | | |
| 11 | deposition | 45 min | 800 | 300 mTorr | 78 sccm $SiCl_2H_2$/21 sccm $NH_3$ |
| 12 | pumpdown | 5 min | 800 | 5 mTorr | |
| 13 | temp. ramp to 400° C. | ~3 hour | 800–400 | 200 mTorr | $N_2$ purge |
| 14 | $N_2$ vent | | 400 | 1 ATM | $N_2$ purge |

Since the silicon nitride film is subjected to a hot potassium hydroxide silicon etch solution later in the window fabrication process, any pinholes or silicon particles in the deposited film will provide etch paths into the silicon substrate. The silicon nitride film can be easily checked for pinholes and particles using a simple etching/bubble detection method. Since this technique is a destructive qualitative technique, only test wafers are evaluated.

The test involves submerging the coated wafer into a hot silicon etch solution and observing any surface bubble generation, which is indicative of silicon etching due to either pinholes or silicon particles in the film. Following the etch test, the wafer is removed, rinsed in deionized water, and examined under a reflected light microscope for signs of silicon etching. Pyramid shaped etch pits will be evident if pinholes were present in the film. If the batch is rejected, then the deposited silicon nitride layer is stripped, and the wafers recleaned.

Photolithography

After the etch stop and protective barrier layers are incorporated into the silicon substrate, the wafer is prepared for photolithographic processing. Photolithography is the process of transferring an image from a pattern (mask) to the wafer using photosensitive material (photoresist). The photolithography process used in window fabrication involves surface preparation, photoresist application, soft bake, UV exposure, developing, hard bake, nitride etching, and photoresist stripping. The structural and chemical properties of the photoresist are changed when exposed to light. Two basic types of photoresist, negative and positive, are used in semiconductor processing. For window fabrication, a positive photoresist is typically used (e.g., AZ1518 from Hoechst, AZ Photoresist Products, Somerville, N.J., which is sensitive to the h-line ($\lambda$=405 nm) from a mercury lamp).

Photoresist is used as a protective barrier to mask the silicon nitride layer from the reactive ion etch ($CF_4/O_2$) used to etch the window openings in the silicon nitride. Once the silicon nitride is selectively etched, the photoresist is removed and the wafers are ready for the bulk silicon etch. Since the CVD silicon nitride is insoluble in the hot KOH solution used to etch silicon, it is used to protect or mask the silicon from the KOH silicon etchant.

Surface Preparation

To ensure both good coverage and adhesion of the photoresist, the wafer surface is prepared to provide a clean, particle free, and dry surface. The presence of particulate and organic contamination on the surface of a wafer can result in pinhole formation in the photoresist and photoresist lift-off. The RCA cleaning procedure is typically used to remove particulate, metallic, and organic contaminants from wafers. If the wafers are handled and stored in proper wafer storage boxes under clean room conditions after the barrier layer deposition step, the RCA cleaning procedure can be omitted. Particulate contamination that commonly occurs while unloading the wafers from the CVD nitride furnace usually can be removed by a filtered high-pressure nitrogen blow-off gun.

Before application of the photoresist, the wafers are dehydrated at 120° C. for one hour to remove surface water. Teflon or other suitable high temperature polymer or quartz wafer carriers should be used. The drying step is necessary to ensure good photoresist adhesion. In addition, an adhesion promoter or primer, HMDS (hexamethyldisilizane) is used to promote good adhesion of the photoresist to the silicon nitride coating. The HMDS is applied to wafers by transporting the hot wafers directly from the dehydrating oven into a closed beaker containing several milliliters of HMDS. The HMDS is then vapor phase transported to the surface of the wafers. After exposure in the HMDS containing beaker, the wafers are promptly removed and allowed to cool to room temperature before application of the photoresist. The HMDS application time must be monitored closely, since photoresist blistering can result if the HMDS coating is too thick.

Photoresist Application

Uniform thin coatings of photoresist are applied by spin coating, where the coating thickness is controlled by the spin speed. Spin coating involves placing a wafer in the spin coater chuck, and then applying photoresist to the center of the wafer and allowing it to spread out into a puddle covering ⅔ of the wafer. The wafer is then spun, and a uniform coating of photoresist should cover the entire wafer; otherwise, the photoresist must be stripped and reapplied. The process requires an application to both sides of the wafer to protect the silicon nitride coating from the nitride etch. This is performed by spin coating and soft baking the photoresist on one side, then repeating the process on the other side. Special precautions should be taken in handling the wafers, since scratching of the photoresist or nitride coating will result in defective parts.

Once the wafers are coated with photoresist, they are dried or soft baked at 90° C. for 30 minutes to promote removal of the solvent from the photoresist and to promote adhesion of the photoresist to the wafer. The temperature of the soft bake must be maintained below 90° C., otherwise the sensitivity of the photoresist can be compromised. The photoactive component can thermally decompose at temperatures greater than 100° C.

Commercial contact and proximity aligners may be used for window fabrication. The photomask is placed in a mounting fixture positioned over a wafer chuck. The photomask is the pattern used in the photolithography process for image transferring. The wafer is loaded and aligned with the primary flat of the wafer, parallel to the alignment flat on the photomask. In this orientation, the windows are parallel to the (110) crystallographic orientation of the silicon.

Figure 1C:
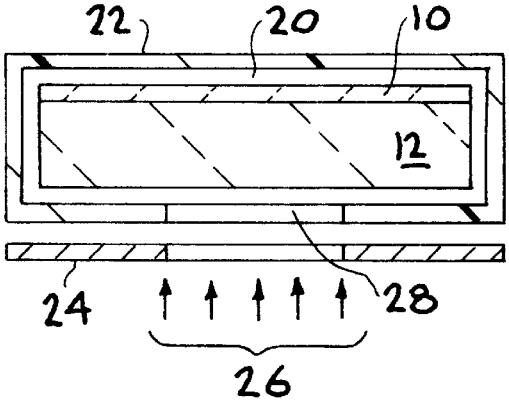

FIG. 1C shows the photoresist layer 22 applied to both sides of the wafer 12, and the photomask 24 on the side opposite the etch stop layer 10. The wafer 12 and photomask 24 are then moved into either close proximity or direct contact before exposure to ultraviolet (UV) light 26. High pressure mercury lamps provide the UV radiation, which is subsequently filtered to the h-line ($\lambda$=405 nm) used to expose the desired region 28 of the photoresist.

One major drawback to contact printing is that mechanical contact of the photomask and the wafer can damage the photoresist and/or photomask resulting in high defect densities. This problem is even more pronounced if particulate contamination is present. Therefore, during a printing run, it is recommended to periodically inspect and clean the photomask of particles and photoresist residue. By using proximity aligners that bring the photomask and wafer into close contact (within 10 $\mu$m), defect densities are greatly reduced.

Photomask Design

The photomask is constructed of precision glass with the patterned chrome layer used to block or mask the UV light. Since the preferred window design uses (100) silicon and an anisotropic silicon etching process, the dimensions must be adjusted to compensate for the 54.74° etch angle and for undercutting of the nitride mask during silicon etching. The amount of undercutting is dependent on the etch concentration, etch solution temperature, and etch time. For the preferred 44% KOH solution (discussed below) at 65° C., the silicon nitride is undercut approximately 10 $\mu$m after 37 hours of etching (time required to etch 510 $\mu$m of Si).

Figure 3:
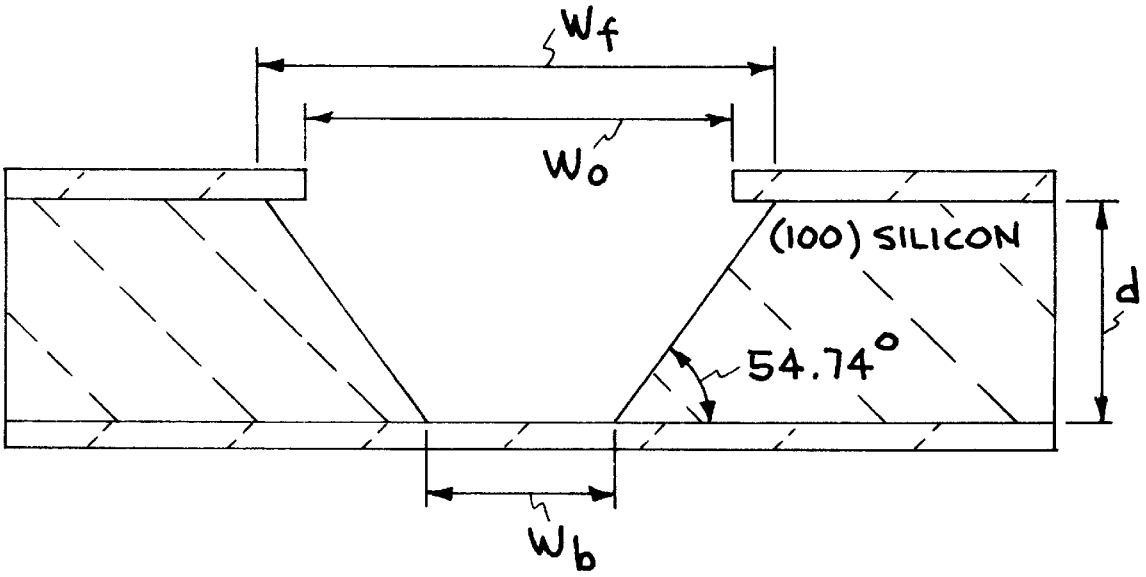
FIG. 3 shows a schematic of (100) silicon etch geometry.

The etch geometry for (100) silicon aligned parallel to the (110) crystal planes is shown in FIG. 3. $W_o$ is the mask opening dimension, $W_b$ is the base dimension, $W_f$ is the final opening (undercut), and d is the etch depth. For the preferred window design parameters, the photomask dimensions ($W_o$) are calculated by simple geometry: $W_o=W_b+2(d/\tan 54.74°)-20$ $\mu$m (amount of undercutting).

Photoresist Developing

Figure 1D:
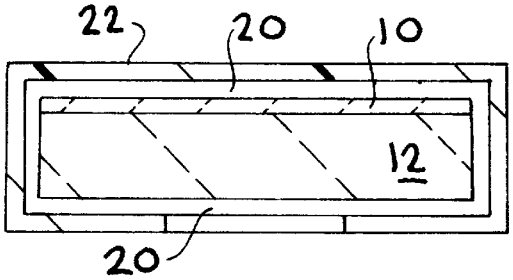

After the photoresist 22 is exposed, the exposed regions 28 are developed to reveal the barrier layer 20, as shown in FIG. 1D. For positive resist, the exposed (unpolymerized) regions are removed by a solution containing tetramethylammonium hydroxide (TMAH). The method involves immersing the exposed wafers into a beaker containing AZ developer diluted 1:1 with deionized water at room temperature under agitation for one minute. The wafers are then rinsed in deionized water for three minutes and air dried. The wafers are then inspected under a reflected light microscope for defects. The exposed regions should be completely free of photoresist, otherwise the exposure time should be increased. Rejected wafers are saved for reprocessing.

A second heat treatment of the photoresist is performed at 110° C. for 30 minutes to promote better adhesion and to drive off water and volatile organics, which can interfere with the nitride etch. The photoresist can soften and flow, resulting in loss of dimensional control if the temperature exceeds the manufacturer's recommended hard bake temperature. For AZ1518 photoresist, the hard bake temperature should not exceed 120° C.

Barrier Layer Etching

Figure 1E:
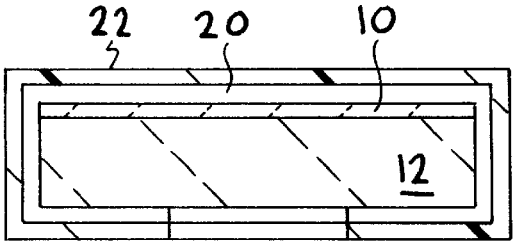

The exposed barrier layer, typically silicon nitride, is etched to reveal the silicon substrate 12, as shown in FIG. 1E. Two methods are commonly used for etching a silicon nitride film: hot (180° C.) phosphoric acid etching and reactive ion etching (RIE). Although the phosphoric acid etch process is a less capital intensive process, it also requires additional process steps. The RIE process is preferable, as it involves less process steps and allows photoresist to be used as a mask during etching.

Phosphoric Acid Etch

Since photoresist is readily removed in hot (180°) phosphoric acid, a hard masking material that is resistant to the corrosive etch solution is required to pattern or selectively etch the silicon nitride coating. Silicon dioxide is typically used as the hard mask material. The silicon dioxide film is deposited on top of the silicon nitride layer, and then patterned with photoresist using the same photolithography sequences outlined above. The silicon dioxide is then selectively etched in buffered hydrofluoric acid (BHF). Buffered hydrofluoric acid contains hydrofluoric acid (HF) and ammonium fluoride ($NH_4F$) as the buffer and is used to avoid photoresist lift-off during etching. The wafers are then etched in the hot (180° C.) phosphoric acid solution (85% wt phosphoric acid). The silicon dioxide mask is then removed in HF. The masking silicon dioxide layer must be free of pinholes and microcracks, otherwise the acid can seep and etch masked regions.

Reactive Ion Etch (RIE)

Alternatively, the silicon nitride coating may be etched by reactive ion etching using a mixture of Freon-14 ($CF_4$) and oxygen ($O_2$). Parallel plate reactors provide good etch uniformity and product yields. Since only the top surface of the wafer is exposed to the plasma in parallel plate reactors, the backside of the wafer is protected from the plasma, thus reducing the chance of forming pinholes on the window side of the wafer. Barrel reactors, on the other hand, expose the entire wafer to the reactive plasma, which increases the possibility of pinhole formation on the window side of the wafer. If a barrel reactor is used for nitride etching, special precautions are needed to ensure that the photoresist on the backside of the wafer (window side) is free of pinholes.

Photoresist Stripping

Figure 1F:
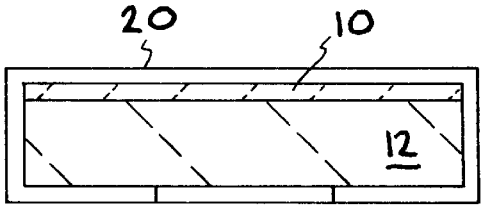

After the barrier layer 20 is etched, the photoresist is stripped, leaving the partially coated silicon substrate 12, as shown in FIG. 1F. If reactive ion etching is used to etch a silicon nitride layer, then the photoresist is typically removed using a heated monoethanolamine solution (R-10, KTI positive photoresist stripper). The R-10 positive photoresist stripper is an excellent substitute for acetone, which was commonly used for photoresist stripping. The stripping operation involves submerging the wafers in heated R-10 solution (60°±5° C.) under agitation for 5 minutes, followed by a 10 minute deionized water rinse. Special precautions must be made to ensure that the R-10 solution is not contaminated with water. Silicon etching will result if water is present in the R-10 solution, so the wafers and cassette must be dry before photoresist stripping.

Wet Chemical Anisotropic Silicon Etching

Wet chemical anisotropic silicon etching is used to complete the fabrication of the windows. This process depends on the etch rate dependence of anisotropic etchants on crystallographic directions. Potassium hydroxide/water ($KOH/H_2O$) solutions and ethylenediamine/water/pyrocatechol (EDP) are common anisotropic silicon etchants used in silicon micromachining processes. These etchants display a very low etch rate of the (111) planes as compared to the (100) and (110) planes. In KOH solutions, for example, the silicon etch rate ratio of the (110):(100):(111) planes is 50:30:1 at 100° C., and 160:100:1 at 25° C. Since the etching process effectively stops or terminates on the (111) crystallographic planes of silicon, fabrication of precision microcomponents is accomplished by precision wafer alignment of specific crystal orientations.

Figure 1G:
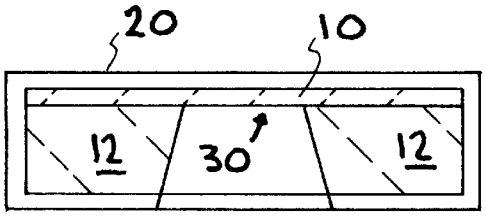
Figure 1H:
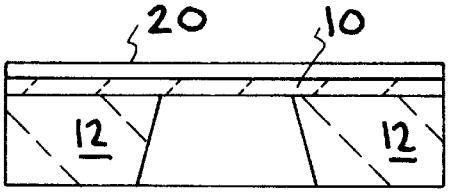
Figure 4A:
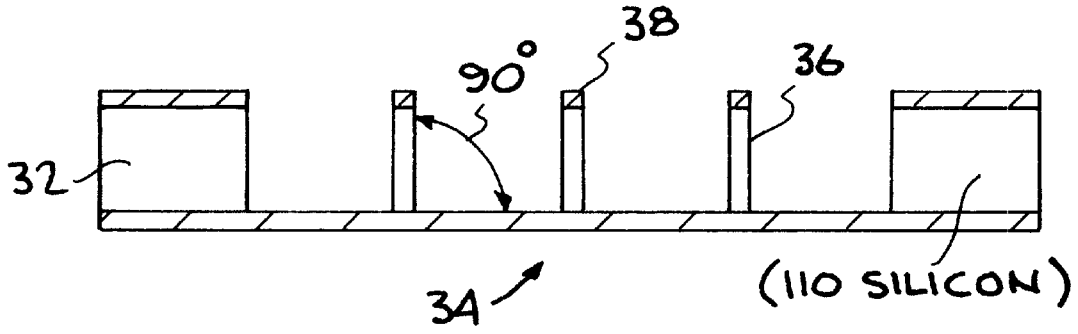
FIG. 4A shows anisotropically etched U-groove silicon structures with straight window support ribs.
Figure 4B:
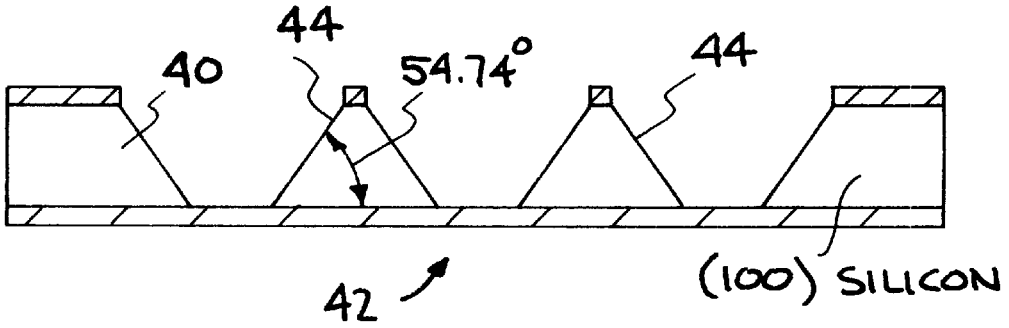
FIG. 4B shows anisotropically etched V-groove silicon structures with tapered window support ribs.

FIG. 1G shows an etched silicon substrate 12 with a bi-material window 30. By properly aligning a (110) or (100) silicon wafer and etch mask, straight wall U-grooves or V-grooves can be fabricated, as shown in FIGS. 4A and 4B, respectively. FIG. 4A shows a cross-section of a vertically anisotropically etched (110) silicon substrate 32 etched parallel to the <110> direction. The window 34 is reinforced by straight support ribs 36. The remaining barrier layer material 38 on the backside of the silicon substrate 32 can provide further structural support, or this layer may be etched, leaving the window shown in FIG. 1H. FIG. 4B shows an anisotropically etched (100) silicon substrate 40 etched parallel to the <110>direction. The window 42 in this case is reinforced by tapered support ribs 44.

A 44% potassium hydroxide/deionized water solution with isopropyl alcohol added is an effective non-toxic anisotropic silicon etch, which effectively stops at high boron and phosphorous doped layers. For KOH based etching solutions in which the concentration falls below 30% KOH, there is a tendency to form deposits ("etch hillocks" or "pyramids") on the surface of the etched (100) wafer. A significant decrease in etch hillock densities on the surface of etched silicon windows results from using 44% KOH.

The etch solution is typically heated to 65° C. for silicon etching. The etchant solution is made by mixing 1,000 grams of reagent grade KOH (88%) to 1,000 milliliters of deionized water in a beaker. The etch solution is heated by placing the beaker in a temperature controlled water bath. The etch time required to fabricate 3 $\mu$m silicon windows from 510 $\mu$m thick silicon wafers is typically 33 hours. Etch termination is visually evident when the hydrogen bubble generation, created by the silicon etching, ceases. The etched windows are then carefully rinsed in deionized water and air dried.

Window Design

Figure 5A:
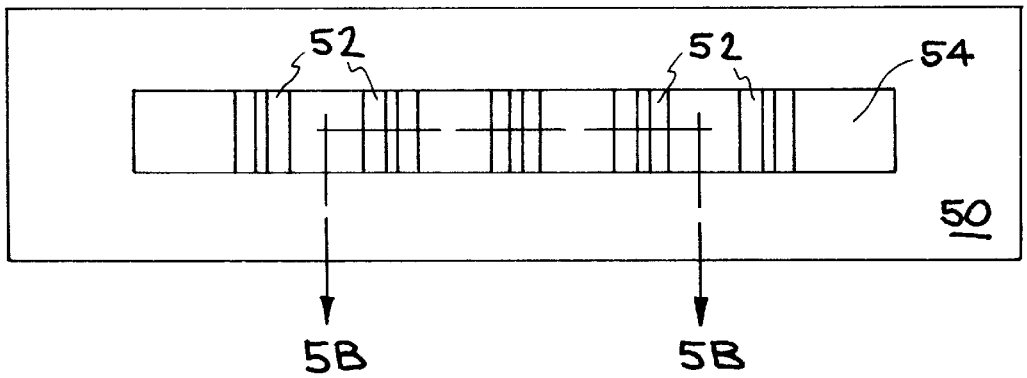
FIG. 5A is a top view of a ribbed window structure according to the present invention.
Figure 5B:
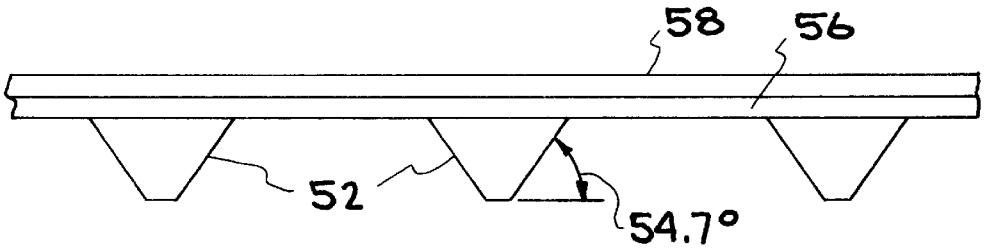
FIG. 5B is a cross-sectional view of a ribbed window structure according to the present invention.

FIGS. 5A and 5B show a top view and cross-section, respectively, of the preferred window design of the present invention. The windows have a rectangular silicon frame 50 (typically about 510 $\mu$m in thickness) with lateral tapered support ribs 52, which support the thin film window 54. The window 54 is typically made of an etch stop layer 56 of boron doped silicon and a barrier layer 58 of silicon nitride. The rectangular support frame 50 provides structural support to the window 54 and provides a bond surface for mounting onto the end of an electron gun tube. The tapered support ribs 52 improve the structural support of the window 54 and provide increased lateral stiffness of the support frame 50. Pronounced improvement in window survivability due to this new design has been observed, particularly for windows that must also survive a high temperature bonding operation for attachment to an electron tube.

The boron doped silicon layer 56 typically ranges in thickness from 0.5 $\mu$m to 3 $\mu$m. The primary purpose of this electrically conductive layer is to remove the electron charge build-up on the window, but this layer also adds strength to the window. This layer is preferably made from either boron doped silicon or boron doped germanium strain compensated epitaxial silicon. The stress of the doped epitaxial film can be adjusted from tensile to compressive by the addition of germanium during the growth process. Excellent results are obtained from 3 $\mu$m thick epitaxial silicon layers strain compensated to a tensile stress of −50 MPa ($5\times10^8$ dynes/$cm^2$).

The silicon nitride layer 58 preferably has a thickness of about 3,000 Å and is composed of low stress silicon nitride (−300 MPa or $3\times10^9$ dynes/$cm^2$). The silicon nitride layer provides strength and chemical resistance to the window. When mounted on an electron gun tube assembly, the silicon film side and tapered support ribs face the electron source (evacuated side).

In an illustrative embodiment, the overall window size is 2.0 mm×25.0 mm, which is comprised of six 2.0 mm×3.75 mm apertures. The apertures are separated by five tapered ribs, which measure 0.5 mm×2.0 mm at the top of the rib. The dimensions of the silicon support frame are 32.0 mm×9.50 mm. Although FIG. 5A shows the arrangement of only one row of apertures, additional rows are typically arranged on a single silicon wafer.

The foregoing description of preferred embodiments of the invention is presented for purposes of illustration and description and is not intended to be exhaustive or to limit the invention to the precise form disclosed. Many modifications and variations are possible in light of the above teaching.

We claim:

1. A method of making a thin window for vacuum applications, comprising:

selecting a substrate comprising silicon;

forming an etch stop layer on one side of the substrate;

forming a continuous protective barrier layer on the etch stop layer of a material different from the etch stop layer;

removing portions of the silicon substrate such that a bilayer window comprising the etch stop layer and protective barrier layer is formed, and such that a plurality of support ribs comprising silicon are formed in contact with the etch stop layer and running the width of the window.

2. A method as recited in claim 1, wherein the etch stop layer comprises a material selected from the group consisting of doped silicon, and conductive carbides, nitrides, and borides.

3. A method as recited in claim 2, wherein the etch stop layer comprises a material selected from the group consisting of $B_4C$, HfC, NbC, TiC, ZrC, SiC, AlN, HfN, NbN, $Nb_2N$, TiN, TaN, $Ta_2N$, ZrN, $HfB_2$, $NbB_2$, $TaB_2$, $TiB_2$, and $ZrB_2$.

4. A method as recited in claim 2, wherein the etch stop layer comprises a material selected from the group consisting of doped silicon and doped silicon carbide.

5. A method as recited in claim 4, wherein at least one dopant is selected from the group consisting of boron, phosphorous, antimony, and arsenic.

6. A method as recited in claim 4, wherein the etch stop layer comprises at least two dopants selected from the group consisting of boron, phosphorous, antimony, arsenic, tin, and germanium.

7. A method as recited in claim 2, wherein the etch stop layer comprises a material selected from the group consisting of boron doped silicon and boron doped germanium strain compensated epitaxial silicon.

8. A method as recited in claim 1, further comprising forming the etch stop layer by a diffusion process.

9. A method as recited in claim 1, further comprising forming the etch stop layer by an epitaxial deposition process.

10. A method as recited in claim 1, wherein the protective barrier layer comprises a material selected from the group consisting of borides, carbides, nitrides, and oxides.

11. A method as recited in claim 10, wherein the protective barrier layer comprises a material selected from the group consisting of $B_4C$, HfC, NbC, doped SiC, TiC, ZrC, $Si_3N_4$, AlN, HfN, NbN, $Nb_2N$, TiN, TaN, $Ta_2N$, ZrN, $HfB_2$, $NbB_2$, $TaB_2$, $TiB_2$, $ZrB_2$, $Al_2O_3$, $ZrO_2$, and $Ta_2O_5$.

12. A method as recited in claim 10, wherein the protective barrier layer comprises silicon nitride.

13. A method as recited in claim 12, wherein the protective barrier layer comprises a low stress silicon nitride film having a tensile stress of about −50 to −500 MPa ($5\times10^8$ to $5\times10^9$ dynes/cm$^2$).

14. A method as recited in claim 1, further comprising forming a third layer on the protective barrier layer, wherein the third layer comprises a material selected from the group consisting of carbides, nitrides, borides, and oxides.

15. A method as recited in claim 1, wherein removing portions of the silicon substrate is carried out by a photolithographic process followed by wet chemical anisotropic etching.

16. A method as recited in claim 15, wherein the wet etching is carried out using a potassium hydroxide/deionized water solution with isopropyl alcohol.

17. A thin window for vacuum applications, comprising:

a first layer effective as an etch stop in silicon etching, comprising a material selected from the group consisting of doped silicon, and conductive carbides, nitrides, and borides;

a continuous protective barrier layer formed on the first layer, comprising a material different from the etch stop layer and selected from the group consisting of borides, carbides, nitrides, and oxides, wherein the first layer and barrier layer form a window; and a plurality of support ribs comprising silicon formed in contact with the first layer and running the width of the bilayer window.

18. A window as recited in claim 17, further comprising a silicon support frame connected to the support ribs.

19. A window as recited in claim 17, wherein the ribs are tapered.

20. A window as recited in claim 17, wherein the ribs are perpendicular to the first layer.

* * * * *